US005217771A

United States Patent [19]

Schmanski et al.

[11] Patent Number: 5,217,771

[45] Date of Patent: Jun. 8, 1993

[54] SOUND BARRIER

[75] Inventors: Donald W. Schmanski; Andrew Huntington, both of Carson City, Nev.

[73] Assignee: Carsonite International Corp., Carson City, Nev.

[21] Appl. No.: 728,189

[22] Filed: Jul. 10, 1991

Related U.S. Application Data

[63] Continuation-in-part of Ser. No. 700,517, Apr. 17, 1991.

[51] Int. Cl.[5] ..... B32B 1/08; E04C 3/30; E04B 1/82; E04B 9/00

[52] U.S. Cl. ..... 428/369; 428/36.5; 428/36.4; 428/34.5; 428/83; 428/81; 428/121; 428/122; 428/188; 428/101; 428/358; 428/99; 52/309.1; 181/284; 181/287; 181/290; 181/291; 181/294

[58] Field of Search ..... 428/36.5, 36.9, 36.91, 428/36.4, 34.5, 83, 81, 121, 122, 188, 296, 358, 99, 101; 40/606, 607, 608; 404/10; 52/144, 145, 731, 732, 309.1; 181/284, 287, 290, 291, 210, 294

[56] References Cited

U.S. PATENT DOCUMENTS 4,840,826 6/1989 Schirasaki et al. ..... 428/188
4,939,037 7/1990 Zign et al. ..... 428/34.5

*Primary Examiner*—Ellis P. Robinson
*Assistant Examiner*—Charles R. Nold
*Attorney, Agent, or Firm*—Thorpe, North & Western

[57] ABSTRACT

A device is provided preventing the transmission of sound, the device being fabricated of polymer composition and comprising a hollow core member formed of fiber-reinforced thermosetting resin, and at least outer member formed of unreinforced thermoplastic resin which is friction fit to the core member. The core member and outer members are preferably formed by pultrusion and extrusion, respectively. Adjacently disposed devices are connected together to form a fence-like barrier through which few or no sound waves are allowed to pass. This system is advantageously used to prevent sound waves emanating from a large transportation structure such as a highway, railroad track, or airport.

4 Claims, 5 Drawing Sheets

SOUND BARRIER

This is a continuation in part of IMPROVED STRUCTURAL DEVICE, Ser. No. 07/700,517 filed Apr. 17, 1991.

BACKGROUND

1. Field

The present invention relates generally to sound barriers and more specifically to a system for absorbing sound waves emanating in particular from highways, railroads, and similar transportation structures.

2. Prior Art

Since the advent of complex motorized transportation systems, such as railroads, automobiles and airplanes, there has been a need to prevent noise caused by such systems from effecting surrounding neighborhoods and businesses. Consequently, a number of devices and systems have been created which have been somewhat effective in eliminating said noise.

Common barriers such as fences constructed of wood or a similar lightweight material probably served as the first noise barriers. While effective in preventing sight access, such barriers are quite ineffective in preventing the transmission of sound waves.

Concrete or masonry barriers and barriers constructed of a similar heavy material are perhaps more commonly used in attempting to prevent noise transmission. Barriers constructed of concrete are far superior to wood structures in accomplishing this goal, and yet it has been determined that concrete barriers and the like tend more to deflect sound waves rather than to dampen or absorb the same. Hence, while these types of barriers seem to be suitable for the accomplishment of some tasks along a highway or railroad track, they leave much to be desired in the area of preventing sound wave transmission.

Lately, much experimentation has been done with barriers having extruded hollow members, particularly those which are modularly connected together, some of which are constructed of thermoplastic materials which absorb rather than deflect noise waves. Such structures may be effective in dampening much of the noise generated by highway traffic, locomotives, airplanes, and the like, although these barriers are not as effective as desirable. Furthermore, many of these barriers ar constructed of materials which break down quickly or lose their resiliency when subjected to adverse conditions such as extreme weather and high-velocity impacts with foreign objects.

Therefore, there exists a legitimate need in the art for a durable sound barrier system which is more effective in dampening sound waves propagated by complex transportation systems. Such a system would advantageously be resilient and capable of surviving modest impacts, and also be capable of some structural support functions.

BRIEF SUMMARY AND OBJECTS OF THE INVENTION

Accordingly, it is a principal object of the present invention to provide a system for dampening and deflecting sound waves.

Another principal objective of this invention is the provision of a barrier which prevents both sight access and the transmission of sound waves therethrough.

A further major objective of this invention is to provide a system for dampening sound waves which can be erected adjacent a major transportation structure, such as a highway, railroad track, or airport, where some impacts with foreign objects are anticipated.

Still another important object of this invention is the provision of a device for dampening sound waves which is sturdy, economical, long-lasting, easily manufactured and installed, and relatively inexpensive based on use of recycled thermoplastics.

Another principle objective is to provide a device for absorbing sound waves, several devices disposed adjacently forming a system and each device having a hollow core member for the absorption of some sound, and a ribbed outer member having several smaller recesses, each of which absorbs and dampens still more of the sound waves.

These and other important objects of the invention are realized in the preferred embodiment thereof which is a device for preventing the transmissions of sound fabricated of polymer composition and which comprises a first member formed of fiber reinforced thermosetting resin, and at least one additional member formed of unreinforced thermoplastic resin, an example being represented by a fiber glass core member and an outer member of thermoplastic material being friction fit to the core member. The hollow core member and outer members are elongate, the core member having a hollow, square-shaped cross-section and each outer member preferably having a generally hollow square-shaped cross-section except for inwardly direct internal ribs. The internal ribs contact the core member and are sized so as to frictionally hold the core member and outer member together in a sturdy, unmovable configuration.

A second embodiment of this invention includes a plurality of angled notches on the outside face of the hollow core member, the outer members, which have a generally rectangular cross-section, having corresponding oppositely angled notches on one side, these notches combining to frictionally fit the hollow core member to each outer member. In this embodiment, some of the outer members may also include notches on opposing sides, thereby providing for connection of a series of core members together to form a fence like barrier system. A third embodiment comprises a tube-like structure formed by coupling two channel members formed respectively of fiberglass and thermoplastic in a tongue in groove fashion.

DESCRIPTION OF THE DRAWINGS

The above and other objects, features and advantages of the invention will become apparent from a consideration of the following detailed description presented in connection with the accompanying drawings in which.

DETAILED DESCRIPTION

Reference is now made to the drawings wherein like numerals are used to designate like components throughout. In general, FIGS. 1–6 show a sound barrier of the present invention which comprises a series of devices 10 aligned adjacent to and connected to each other, each device 10 being fabricated of a polymer composition, and comprising a hollow core member 12 formed of fiber reinforced thermosetting resin, and at least one outer member 14 formed of unreinforced thermoplastic resin which is friction fit to the core member 12. Each of these components will be described in greater detail hereafter.

Hollow core member 12, which, as mentioned above, is formed of fiber reinforced thermosetting resin, and is preferably formed by the process of pultrusion. Hollow core member 12 is elongate and preferably has a square-shaped cross-section, and thus has a generally tubular appearance. Because of the material from which the walls of the core member 12 are constructed, it provides some structural integrity and rigidity for the device 10. The thermosetting resin from which core member 12 is constructed more importantly provides resilience to the device 10 such that foreign objects coming in contact with the device 10, such as rocks, bottles, and even automobiles, will not be prone to break or permanently damage the device 10.

In contrast, each outer member 14 is constructed of a thermoplastic material which provides some strength and increased structural integrity to the device 10. In one embodiment of outer member 14, shown in FIGS. 2 and 3, the outer member 14 has a generally hollow square-shaped cross-section and completely surrounds the hollow core member 12 to enhance sound absorption.

Figure 3:
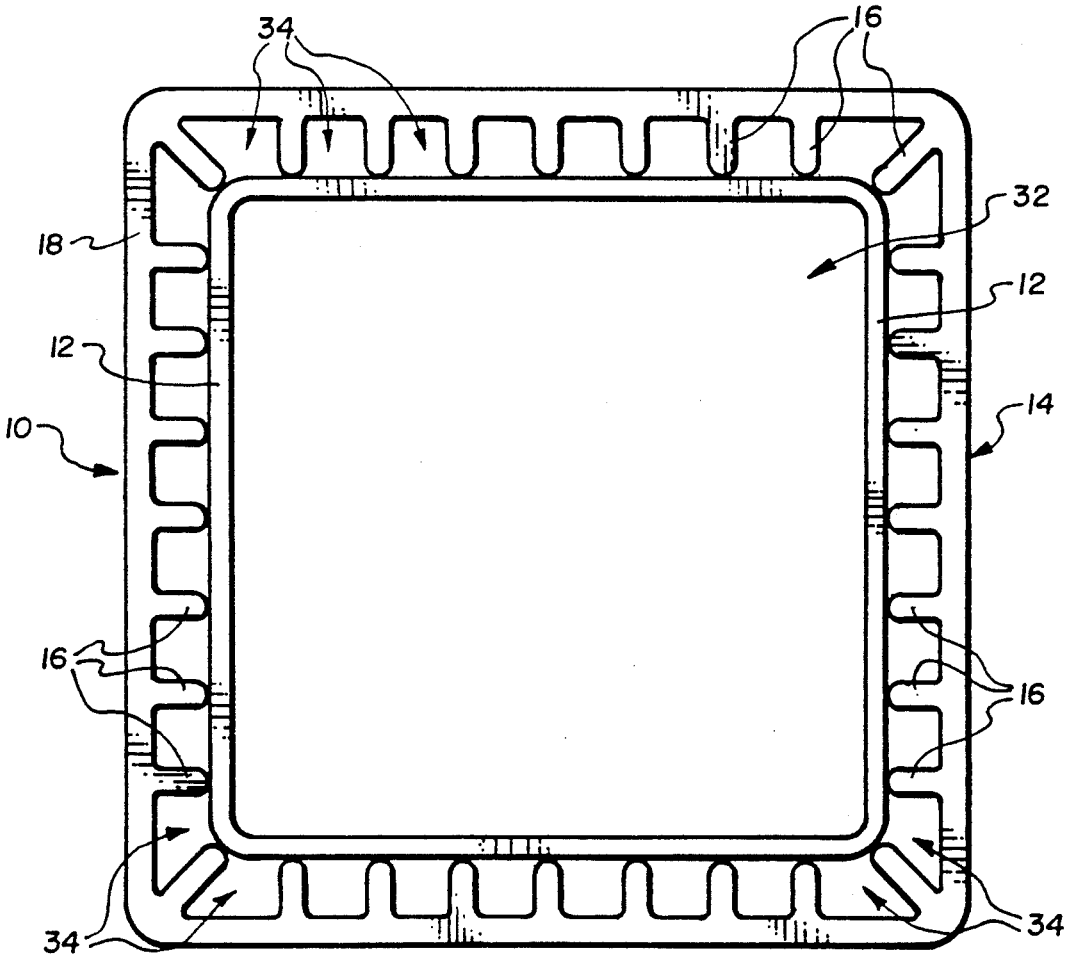
FIG. 3 is an enlarged cross-sectional plan view of one preferred embodiment of the device of FIG. 2.

Referring now to FIG. 3, this embodiment of outer member 14 has a plurality of internal ribs 16 for contacting core member 12, the ribs 16 forming recesses 34 between the core member 12 and the outer member 14 for absorbing and blocking sound transmission. As shown, each of the internal ribs 16 is an integral part of outer member 14, the entire outer member 14 preferably being formed by the well-known process of extrusion.

Figure 1:
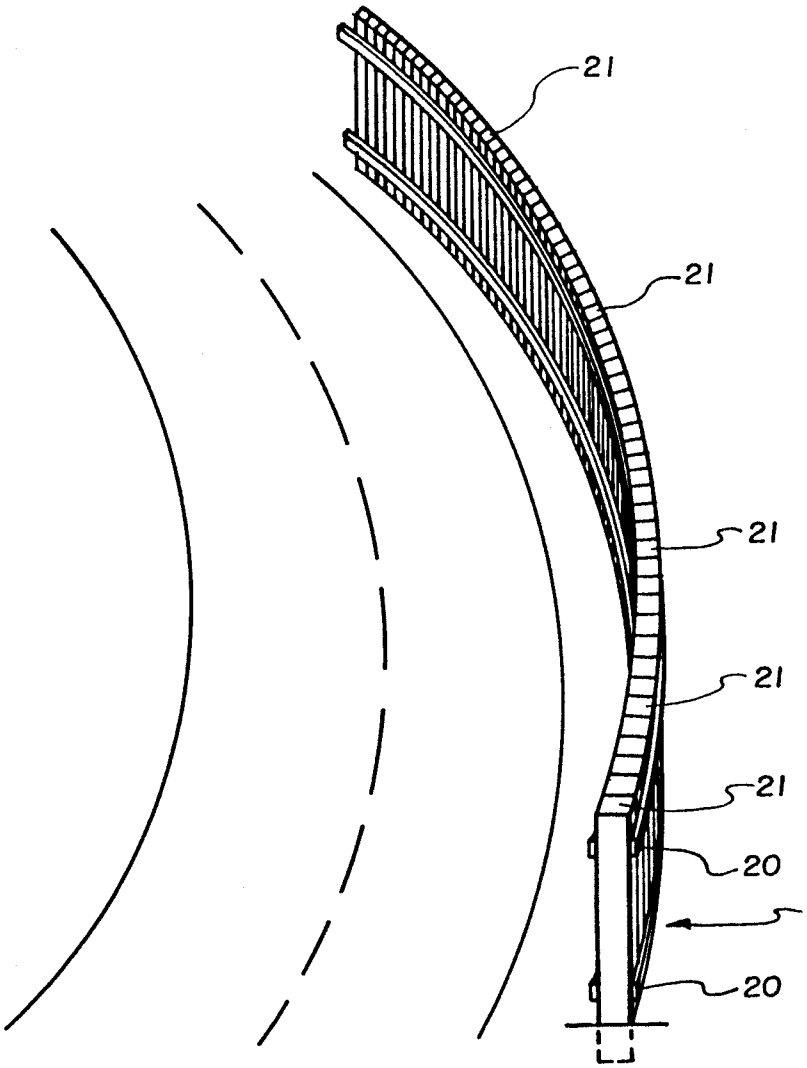
FIG. 1 is a perspective view of a highway adjacent which is shown the system of the present invention.
Figure 2:
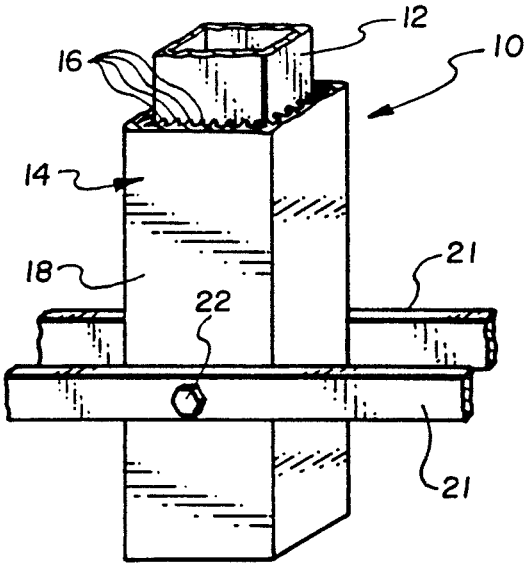
FIG. 2 is an isolated cutaway perspective view of a single device of the invention of FIG. 1.

In the embodiment of FIG. 3, hollow core member 12 and outer member 14 are connected only by friction, thus requiring no glue, staples, welding, or other means of connecting the two members together. Besides having internal ribs 16, outer member 14 further comprises a continuous exterior surface 18 to which the internal ribs 16 are integrally attached. As best seen in FIG. 2, exterior surface 18 of outer member 14 is exposed to outside elements such as weather which have the effect of deteriorating the material. However, because of the thermoplastic resin from which outer member 14 is constructed, deterioration due to weather and other sources is minimized, if not completely eliminated. The poor strength and resilience of the exterior thermoplastic material is reinforced by the internal thermo-setting, fiber reinforced resin structure.

Still referring to FIG. 2, a method of supporting adjacently disposed devices 10 is shown. The support structure comprises horizontal support slats 20 mounted on opposite sides of the aligned vertical blocking devices. The opposing slats are bolted together 22 to sandwich the devices therebetween. These support slats are mounted on support posts 21 which are buried at an appropriate depth in the ground.

It will become apparent to one skilled in the art that the advantage provided by the embodiment of FIGS. 2 and 3 is the provision of the plurality of chambers 34 wherein sound waves are attenuated. Most prior art devices at most provide only one such chamber, this chamber being the hollow interior portion of an elongate member. This invention has such a chamber 32, as well as the series of additional chambers or recesses 34 formed, as explained above, by the internal ribs 16. Thus, sound waves are better able to dissipate within the device 10 and prevent transmission therethrough.

Figure 4:
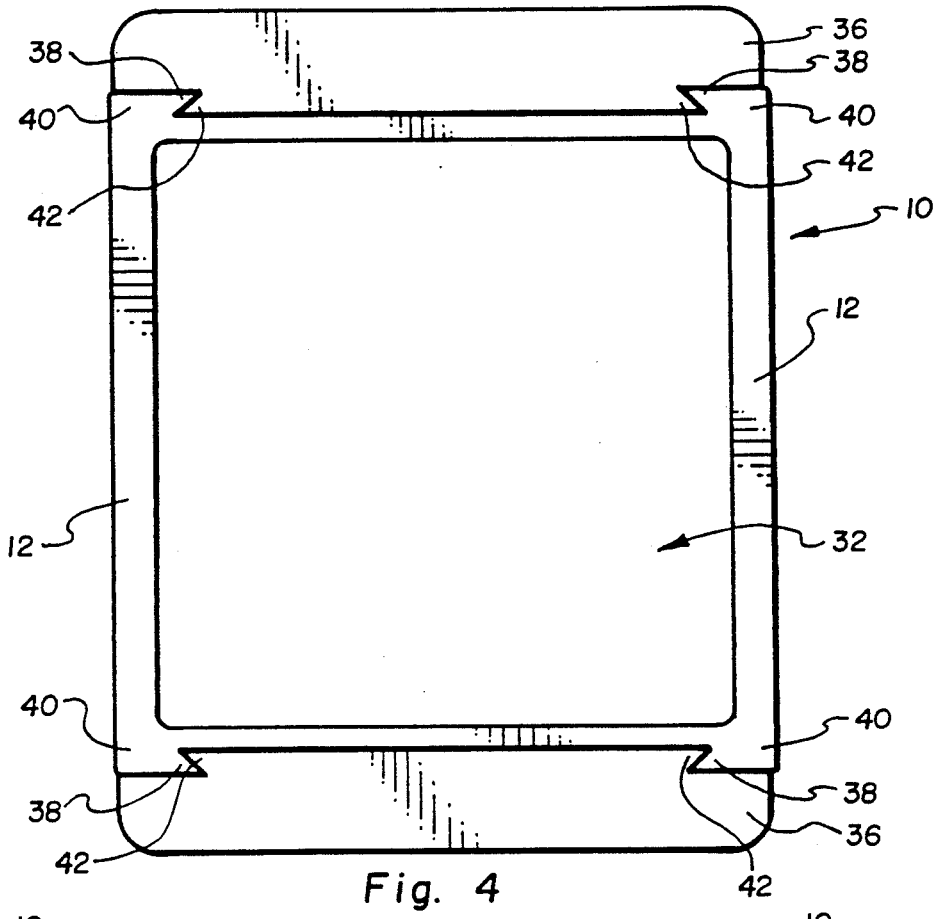
FIG. 4 is an enlarged cross-sectional plan view of an alternative preferred embodiment of the device of FIG. 2.

A second embodiment of device 10 is illustrated in FIG. 4. This embodiment comprises core member 12, which has the same general shape as the core member illustrated in FIG. 3, except for notches hereinafter explained, and a plurality of outer members 36 each of which has a generally rectangle shape, except for notches, also hereinafter explained. Outer members 36 are similar to outer member 14 in construction but differ in shape and method of attachment to core member 12. This outer member 36 may be formed of foamed thermoplastic to reduce material costs and also to enhance absorption.

As mentioned, the core member 12 shown in FIG. 4 includes a plurality of angled notches 38 in opposing sides thereof. The notches 38 are angled outwardly from the corner portion 40 of core member 12. Each outer member 36 includes corresponding oppositely angled notches 42, the notches 38 of core member 12 and the notches 42 of each outer member 36 combining to frictionally fit the core member 12 to the outer member 36.

Specifically, this embodiment provides a device useful as part of a wall array of such devices for preventing the transmission of sound, wherein the device comprises an elongate first member 12 fabricated from fiber reinforced, thermosetting resin and includes first frictional interlock means comprising the first part of tongue in groove notches 38. This interlock means provides connection to a second elongate member 36 formed of unreinforced thermoplastic resin which has second interlock means 40 for rigidly engaging the interlock means of the first member in frictional contact to form a tubular member having (i) a thermoplastic side of the second member exposed to absorb sound waves, a fiber reinforced thermosetting member (ii) to provide rigidity for column support to the device, and (iii) an interior hollow section to assist in dissipation of sound.

Figure 5:
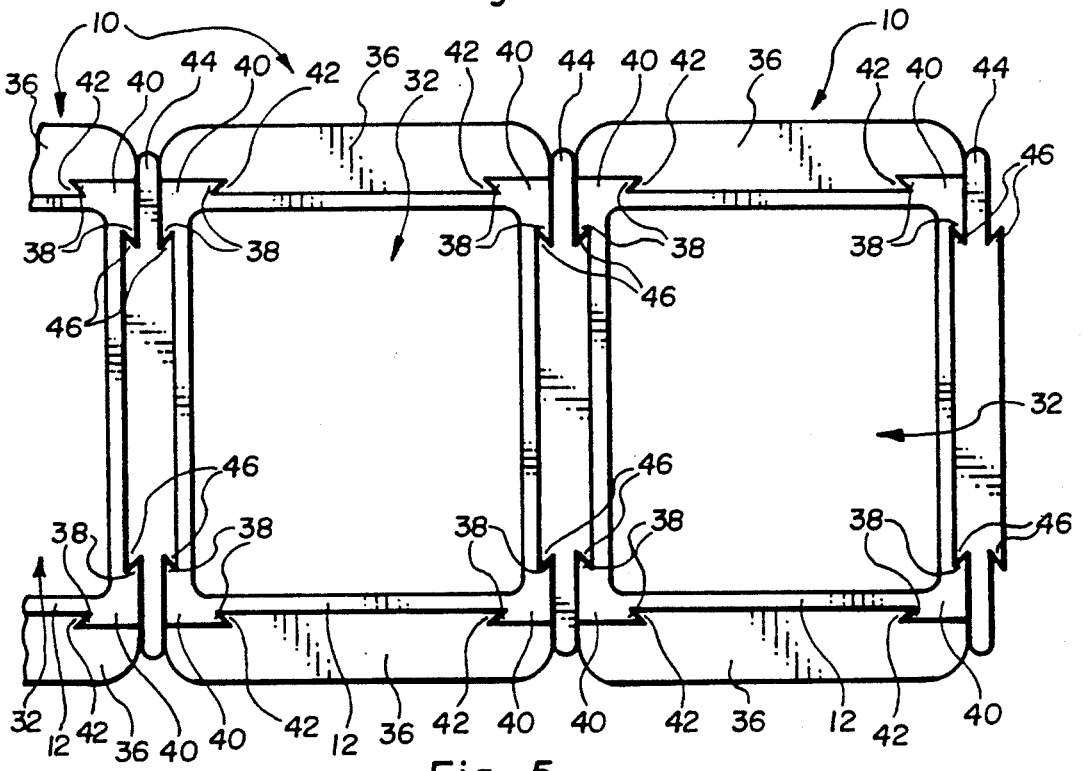
FIG. 5 is another preferred embodiment of the system of FIG. 1 shown in cross-sectional plan view.
Figure 6:
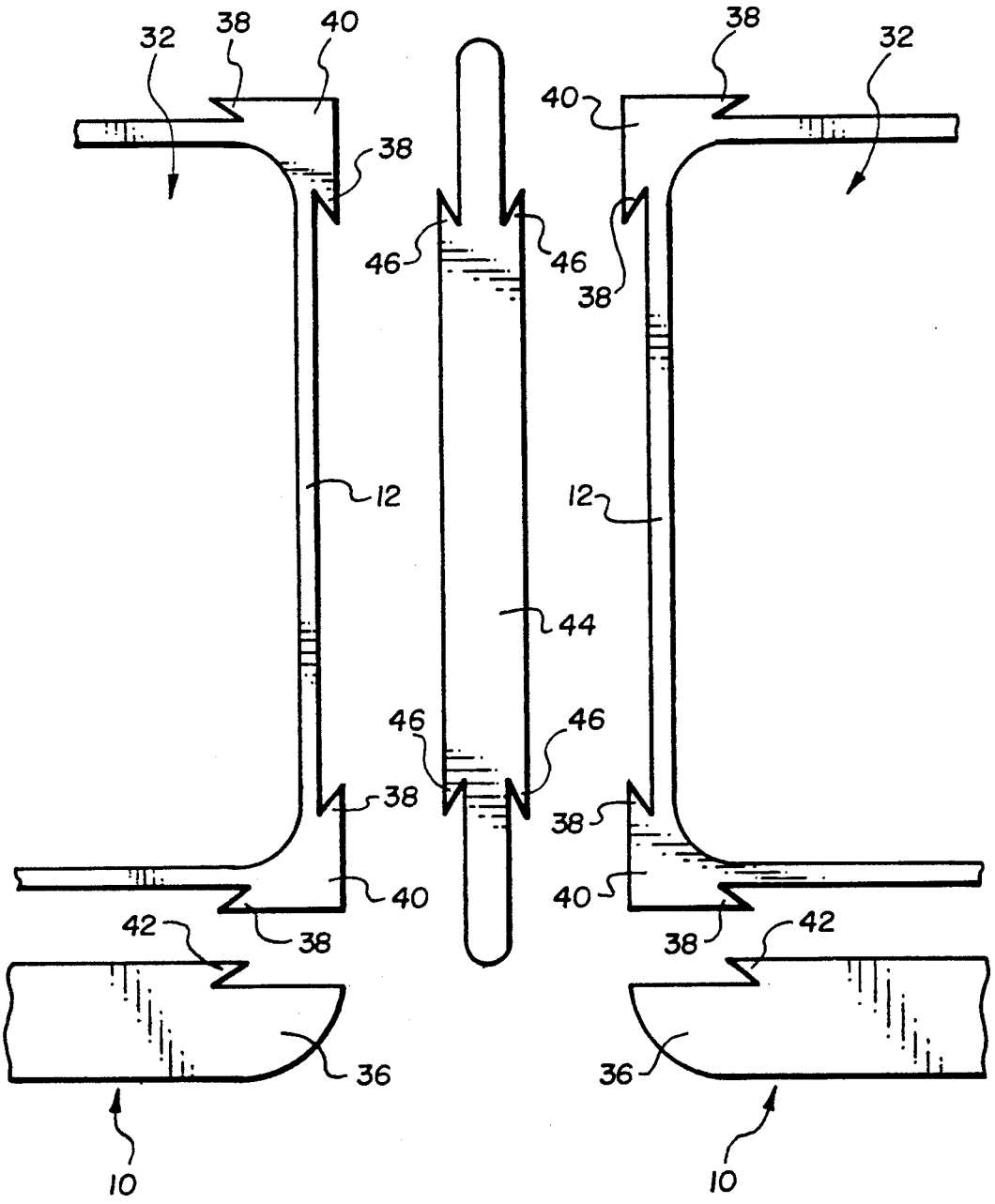
FIG. 6 is an exploded cross-sectional plan view, shown enlarged, of the embodiment of FIG. 5.

Another method of connecting a plurality of adjacently disposed devices 10 together, shown in FIGS. 5 and 6, may be used. In the embodiment of FIGS. 5 and 6, the core member 12 has a set of outwardly angled notches 38 in each of the four sides thereof near the corners 40. As shown, outer member 36 is frictionally fit to core member 12 as described in connection with FIG. 4.

Further, an unreinforced thermoplastic connector 44 is provided. The connector 44 has angled notches 46 which correspond appropriately with and fit into angled notches 38 of two different core members 12, as illustrated, to connect adjacently disposed devices 10. See FIG. 5. This method of connecting adjacently disposed devices 10 is advantageous because the thermoplastic connector 44 has sound inhibiting qualities similar to outer member 36 and outer member 14, described above.

Because core member 12 is frictionally fit to the outer members 14 or 36, assembly of a system having a plurality of devices 10 is easily accomplished. Similarly, disassembly is less time consuming and less tedious than methods heretofore known or used. The system of this invention may be constructed virtually at any location where sound waves are desirously prevented from further transmission. Ideally, this system is used adjacent a highway, a railroad track, or airport, although many other sites would fall within the purview of this invention. Each device 10 mav be anchored in the ground or a footing by methods well-known in the art, such as embedding one end thereof into the ground or setting an end into cement. They may also be turned to horizontal orientation and supported at opposing ends in vertical posts with mounting tracks, formed in the posts.

Although the preferred embodiments of the present invention have been illustrated and described, it is to be understood that the present disclosures made by way of example and that various other embodiments are possible without departing from the subject matter coming within the scope of the following claims, which subject matter is regarded as the invention.

Figure 7:
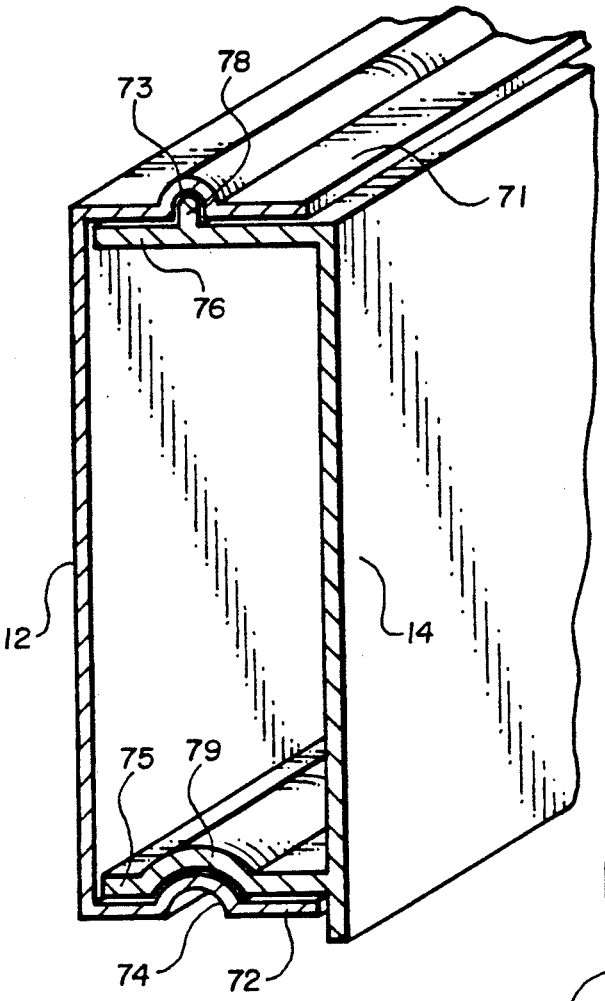
FIG. 7 shows a perspective view of a coupled pair of channel members forming a tubular member.
Figure 8:
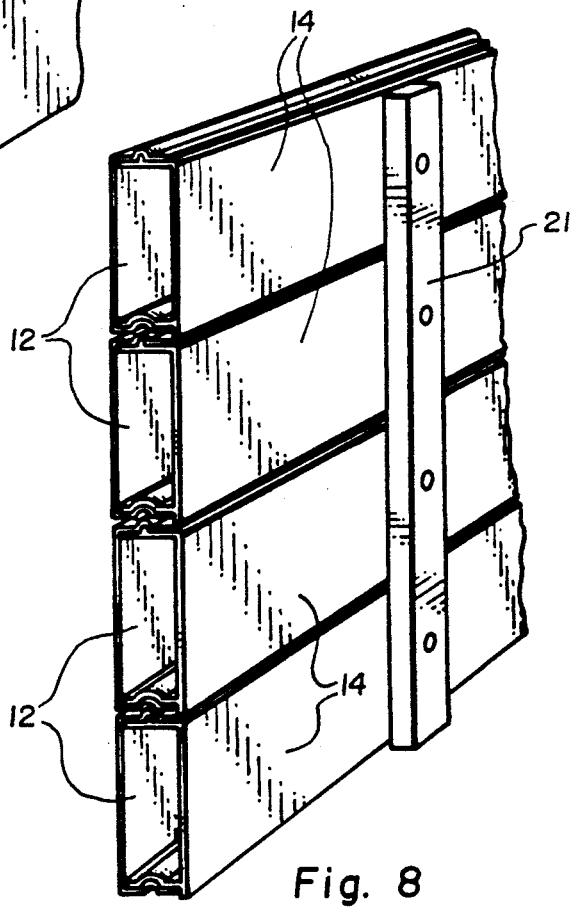
FIG. 8 illustrates a plurality of the tube structures of FIG. 7 stacked horizontally to form a sound barrier.

For example, FIGS. 7 and 8 show an embodiment wherein the first member 12 formed of fiber reinforced resin has a channel configuration including first and second end sections 71 and 72, each end section including first interlock means 73 and 74 having a similar tongue in groove configuration. The second member 14 formed of thermoplastic composition also has a channel configuration with first and second end sections 75 and 76. Second interlock means 78 and 79 are configured for rigidly engaging the respective interlock means of the second and first sections of the second member in frictional contact to form a tubular member having (i) a thermoplastic side of the second member exposed to absorb sound waves, (ii) a fiber reinforced thermosetting member to provide rigidity for column support of the device, and (iii) an interior hollow section to assist in dissipation of sound. A similar anchor post 21 is provided to couple a plurality of the devices 10 to form a side-by-side array of devices in a sound barrier configuration.

As with previous products, the thermoplastic material used for the sound barrier may be recycled polyethylene or similar thermoplastic material to greatly reduce the cost of the sound barrier assembly. Typical dimensions for this assembly will range in depth from one to eight inches (from top to bottom of each tubular configuration and from one to three inches in width) from face to face of opposite sides. The extruded scrap channel of polyethylene may have a wall thickness of one-eight inch to two inches in thickness, depending on the physical properties desired. As will be noted in FIG. 8, these respective tubular members can be stacked so that the top tongue 79 seats in the bottom groove 74. The fiberglass wall thickness will be approximately one-eight inch, but also may vary depending upon physical properties desired.

We claim:

1. A sound dampening device useful for forming a sound barrier wall prepared from a plurality of said devices, said device comprises:

an elongate first member having a channel configuration and being fabricated from fiber reinforced, thermosetting resin and including first frictional interlock means;

a second elongate member having a channel configuration and being formed of unreinforced thermoplastic resin and having second interlock means;

said first and second interlock means being removably interengaged between the first member and the second member in frictional contact to form a tubular member having a thermoplastic side of the second member exposed to absorb sound waves, a fiber reinforced thermosetting member to provide rigidity for column support of the device, and an interior hollow section to assist in dissipation of sound.

2. A device as defined in claim 1, further comprising means for coupling to a plurality of the devices to form a side-by-side array of devices in a sound barrier wall configuration.

3. A device as defined in claim 1, wherein the first and second interlock means comprise tongue-in-groove structure which can be removably engaged to form the tubular member.

4. A device useful as part of a wall array of such devices for preventing the transmission of sound, said device comprising:

an elongate first member having a channel configuration and being fabricated from fiber reinforced, thermosetting resin and including first frictional interlock means;

a second elongate member formed of unreinforced thermoplastic resin and having second interlock means;

said first and second interlock means being removably interengaged between the first member and the second member in frictional contact to form a tubular member having a thermoplastic side of the second member exposed to absorb sound waves, a fiber reinforced thermosetting member to provide rigidity for column support of the device, and an interior hollow section to assist in dissipation of sound.

* * * * *